US006386941B1

(12) United States Patent
Lin

(10) Patent No.: US 6,386,941 B1
(45) Date of Patent: May 14, 2002

(54) SOFT-SHELLED CRYSTAL BALL

(76) Inventor: Yu-Shu Lin, No. 78-1, Pushin Ts'un, Dayuan Shiang, Taoyuan (TW), 337

( * ) Notice: Subject to any disclaimer, the term of this patent is extended or adjusted under 35 U.S.C. 154(b) by 0 days.

(21) Appl. No.: 09/726,415

(22) Filed: Dec. 1, 2000

(51) Int. Cl.[7] ..... G09F 19/00
(52) U.S. Cl. ..... 446/267; 446/176; 40/406
(58) Field of Search ..... 40/406; 446/176, 446/180, 267

(56) References Cited

U.S. PATENT DOCUMENTS 5,971,831 A * 10/1999 Hsu ..... 446/267
6,061,937 A * 5/2000 Meng ..... 446/267 X
6,132,284 A * 10/2000 Lin ..... 446/267
6,165,041 A * 12/2000 Lin ..... 446/267

* cited by examiner

*Primary Examiner*—John A. Ricci
(74) *Attorney, Agent, or Firm*—Dougherty & Troxell

(57) ABSTRACT

A soft-shelled crystal ball having an improved baffle is provided. The baffle is positioned in a soft shell of the crystal ball for forming a reduced neck portion of the crystal ball. The baffle is provided with a downward projected filling port, an upper part of which defines a stepped inner hole sealed with a first stepped plug and a lower part of which is a tube portion sealed with a second plug. The baffle is also provided along a lower outer periphery with a plurality of stubs. The soft shell extended downward from the neck portion is tightened around the tube portion of the filling port and is supported by the stubs to provide a lower space below the baffle. The soft shell extended beyond the tube portion is tightened again to ensure that the crystal ball is absolutely leakproof. The space below the baffle is communicable with the crystal ball through holes provided on the baffle. When the soft-shelled crystal ball is compressed or patted, liquid in the crystal ball flows into and out of the lower space to produce visible liquid flows in the crystal ball.

2 Claims, 4 Drawing Sheets

SOFT-SHELLED CRYSTAL BALL

BACKGROUND OF THE INVENTION

The present invention relates to an ornamental soft-shelled crystal ball, and more particularly to a soft-shelled crystal ball having an improved baffle below a lower reduced neck portion of the crystal ball. The baffle is provided with a downward projected filling port, an upper part of which defines a stepped inner hole sealed with a first stepped plug and a lower part of which is a tube sealed with a second plug. A soft shell of the crystal ball extends beyond the baffle is first tightened around the filling port and then below the second plug to make the crystal ball absolutely leakproof. The baffle is also provided with through holes and downward projected stub, so that a space communicable with the crystal ball is formed between the baffle and the tightened soft shell to facilitate forming of visible liquid flows in the crystal ball when the same is patted or compressed.

Transparent balls filled with liquid and other decorative floating articles are a popular indoor ornament and are usually referred to as a crystal ball. In the early stage, most crystal balls have a hard shell made of glass material that is fragile and expensive. There are also crystal balls having a shell made of injection molded hard plastic materials, such as a transparent acrylic material. Such hard plastic crystal balls are impact-resistant and inexpensive. Recently, there are also crystal balls formed from a liquid-filled soft spherical shell made of a transparent plastic material. There are frequently changes in the design of such crystal balls in an attempt to simplify or improve the manner of sealing the crystal ball so that the same is leakproof. Either the hard-shelled or the soft-shelled crystal balls, they all have a lower reduced neck portion. The neck portion, on the one hand, highlights the spherical shape of the crystal ball and, on the other hand, enables the crystal ball to stably locate on a matched seat for display. Since the crystal ball is filled with liquid via the reduced neck portion, it is necessary to make the neck portion leakproof after filling the crystal ball.

In the case of a conventional soft-shelled crystal ball, when the thin and soft shell is pressurized and filled with liquid to form a ball-shaped body, an opening or the filling hole of the shell is tightened to prevent the soft shell from leaking. Generally, a commercially available toothed binding belt is used to tighten the soft shell without the risk of becoming loosened. The tightened portion of the soft shell forms a reduced neck portion of the crystal ball for engaging with a top opening of a seat. To facilitate the forming of the reduced neck portion of the soft-shelled crystal ball, a disc-shaped baffle is usually positioned in the soft shell in advance to locate below the seat. The baffle has a diameter slightly larger than an inner diameter of the top opening of the seat, so that the soft shell is bent when it passes the overlapped top opening of the seat and the baffle and forms the reduced neck portion around the top opening of the seat. The disc-shaped baffle in the soft-shelled crystal ball is structurally and functionally equivalent to a bottom cover positioned in a neck portion of a hard-shelled crystal ball to seal the neck portion. That is, the baffle is basically an element adapted to seal the reduced neck portion of the soft-shelled crystal ball.

SUMMARY OF THE INVENTION

It is a primary object of the present invention to provide a soft-shelled crystal ball having an improved baffle, so that filling of the soft shell with liquid and sealing of the filling hole via the baffle could be simplified while an absolutely leakproof soft-shelled crystal ball could be manufactured.

Another object of the present invention is to provide a soft-shelled crystal ball having an improved baffle, wherein the baffle is provided with means to support the soft shell of the crystal ball passing below the baffle, so that a lower space is formed in the crystal ball below the baffle to communicable with an upper space above the baffle, allowing liquid in the upper space to flow into and out of the lower space to create visible flows in the soft-shelled crystal ball when the same is patted or otherwise compressed. To achieve the above and other objects, the soft-shelled crystal ball of the present invention mainly includes a baffle that is provided with a downward projected filling port, an upper part of which defines a stepped inner hole sealed with a first stepped plug and a lower part of which is a tube portion sealed with a second plug. The baffle is also provided along a lower outer periphery with a plurality of stubs. The soft shell extended downward from the neck portion is tightened around the tube portion of the filling port and is supported by the stubs to provide a lower space below the baffle. The soft shell extended beyond the tube portion is tightened again to make the crystal ball absolutely leakproof. The space below the baffle is communicable with the crystal ball through holes provided on the baffle. When the soft-shelled crystal ball is compressed or patted, liquid in the crystal ball flows into and out of the lower space to produce visible liquid flows in the crystal ball.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
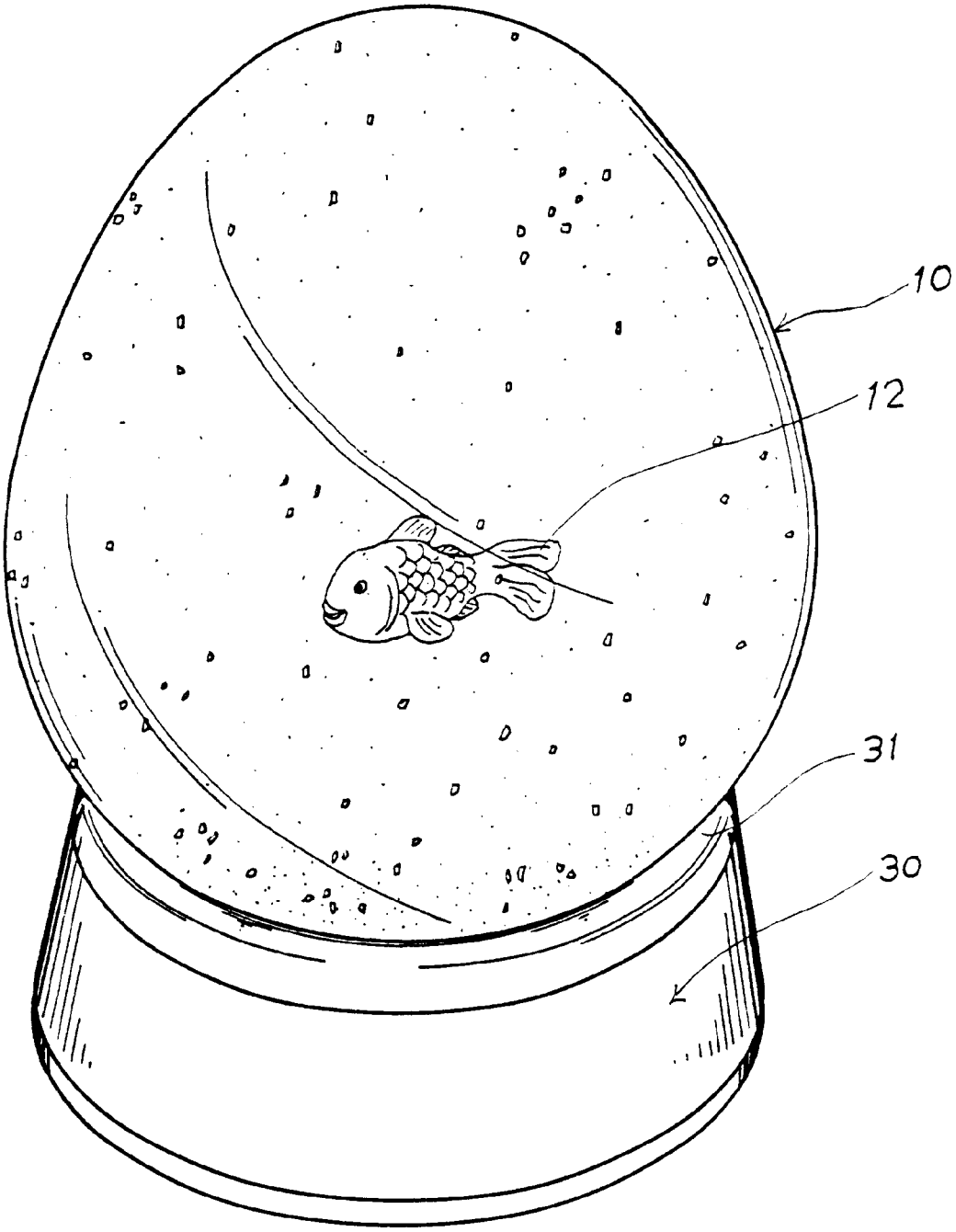
FIG. 1 is a perspective of a soft-shelled crystal ball according to a first embodiment of the present invention.
Figure 2:
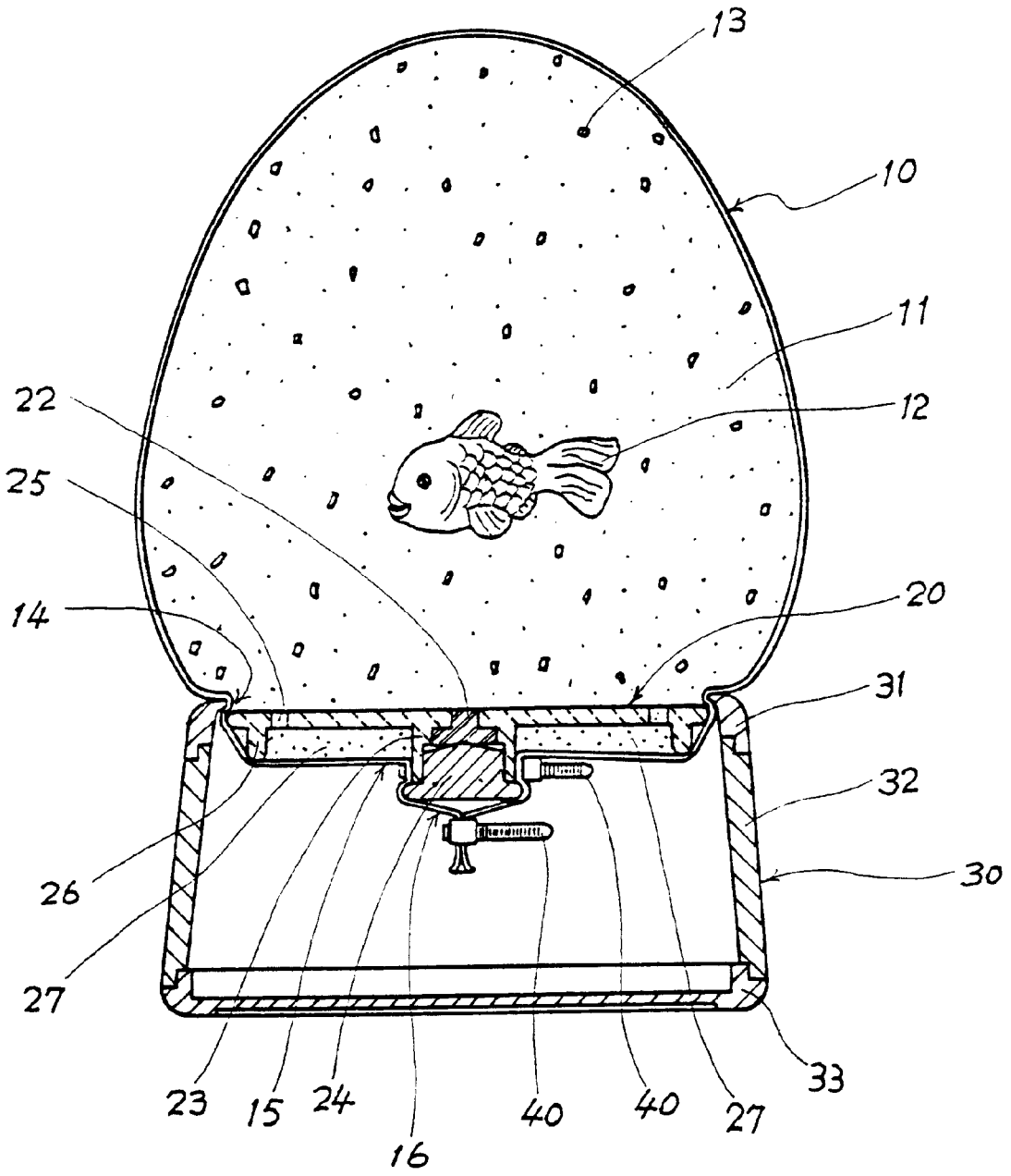
FIG. 2 is a sectional view of the soft-shelled crystal ball of FIG. 1 in an assembled state.
Figure 3:
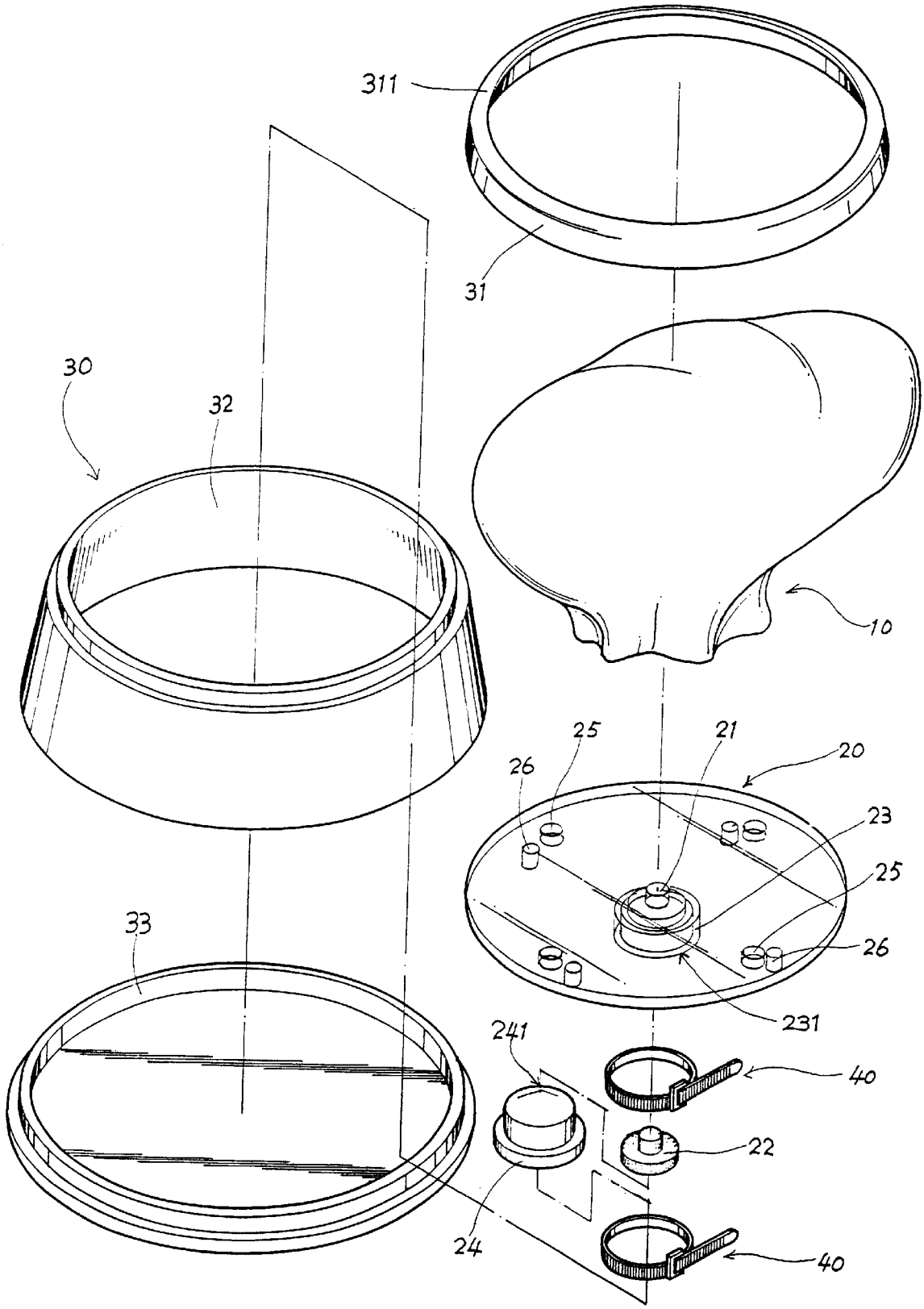
FIG. 3 is an exploded perspective of the soft-shelled crystal ball of FIG. 1.

Please refer to FIGS. 1, 2 and 3 in which a soft-shelled crystal ball according to a first embodiment of the present invention is shown. The soft-shelled crystal ball mainly includes a soft shell 10, a baffle 20, and a seat 30.

The soft shell 10 is a thin and soft layer made of a transparent plastic material or other suitable material molded into a substantially spherical bag having an opening provided at one side thereof. The soft shell 10 may be suitably pressurized and filled with liquid 11, such as water, to produce a shape close to a ball. Other floating decorative articles 12 and metallic chips 13 may also be put in the soft shell 10 to decorate the crystal ball.

The baffle 20 is a disc having a predetermined thickness and being positioned in the soft shell 10 close to the opening thereof after the soft shell 10 is filled with liquid 11 and decorative articles 12, 13. There is a predetermined length of the soft shell 10 extended beyond the baffle 20, so that the opening of the soft shell 10 could be properly tightened below the baffle 20 to prevent leakage of the liquid 11 out of the crystal ball via the opening.

The seat 30 is divided into an upper ring portion 31, a middle annular wall portion 32, and a bottom 33. An inner circumferential edge 311 of the upper ring portion 31 is diametrically slightly smaller than the baffle 20. The soft shell 10 with the baffle 20 positioned therein is adapted to upward extend through the upper ring portion 31 of the seat 30 until the baffle 20 is in contact with and stopped by the inner circumferential edge 311 from moving upward any further. As can be seen from FIG. 2, the soft shell 10 is bent at and clamped between a joint of the baffle 20 and the inner circumferential edge 311 of the upper ring portion 31 to form a reduced neck portion 14 of the soft-shelled crystal ball. The reduced neck portion 14 of the crystal ball of the present invention is basically equivalent to the neck portion of the conventional hard-shelled crystal ball in terms of its structure and function. However, in the conventional hard-shelled crystal ball, the baffle serves as a bottom plate to close the opening of the neck portion and the neck portion is the only one place at where the crystal ball is sealed to prevent leakage. On the other hand, in the present invention, the soft shell 10 downward extends from the reduced neck portion 14 and the baffle 20 by a predetermined length and is further tightened below the baffle 20 twice to ensure that the crystal ball is completely leakproof.

The baffle 20 for forming the reduced neck portion 14 on the soft shell 10 of the crystal ball of the present invention includes a downward extended filling port, an upper portion of which defines an inner downward expanded and stepped filling hole 21 that is tightly sealed with a first plug 22 made of a soft and elastic plastic material and having a shape corresponding to that of the stepped filling hole 21, such that the filling hole 21 is absolutely leakproof. Since the first plug 22 is made of a soft and elastic material, it is also possible to fill the soft shell 10 with liquid 11 by piercing through the first plug 22 with a needle cannula (not shown) . The soft and elastic material of the first plug 22 will automatically seal any needle hole after the needle cannula is extracted from the first plug 22. A lower portion of the downward filling port of the baffle 20 is a tube 23 defining an expanded hole 231 into which a second plug 24 made of a plastic material is upward inserted to seal the hole 231. The second plug 24 has a conic front 241 adapted to press against the first plug 22 to ensure tight and firm location of the first plug 22 in the stepped filling hole 21.

A first extension portion 15 of the soft shell 10 that is closely below the reduced neck portion 14 and the baffle 20 is tightened around the tube 23 by means of a first fastener 40, such as a commercially available toothed binding belt. A second extension portion 16 of the soft shell 10 that is closely below the first extension portion i5 is further tightened below the second plug 24 by mean of a second fastener 40, such as the toothed binding belt.

There are a plurality of through holes 25 evenly distributed on the baffle 20, and a plurality of short stubs 26 having a predetermined length evenly provided along a bottom outer periphery of the baffle 20. An area of the first extension portion 15 of the soft shell 10 between the reduced neck portion 14 and the first fastener 40 is supported by the stubs 26 to separate from a lower surface of the baffle 20 so that a large lower space 27 is produced between the baffle 20 and the first extension portion 15 of the soft shell 10. The liquid 11 in the crystal ball above the baffle 20 flows into and out of the lower space 27 via the through holes 25 when the soft shell 10 of the crystal ball is patted, compressed or otherwise vibrated, producing visible liquid flows in the crystal ball with the floating decorative article 12 and the metallic chips 13 moving in the liquid 11 to show a dynamic and beautiful vision.

Figure 4:
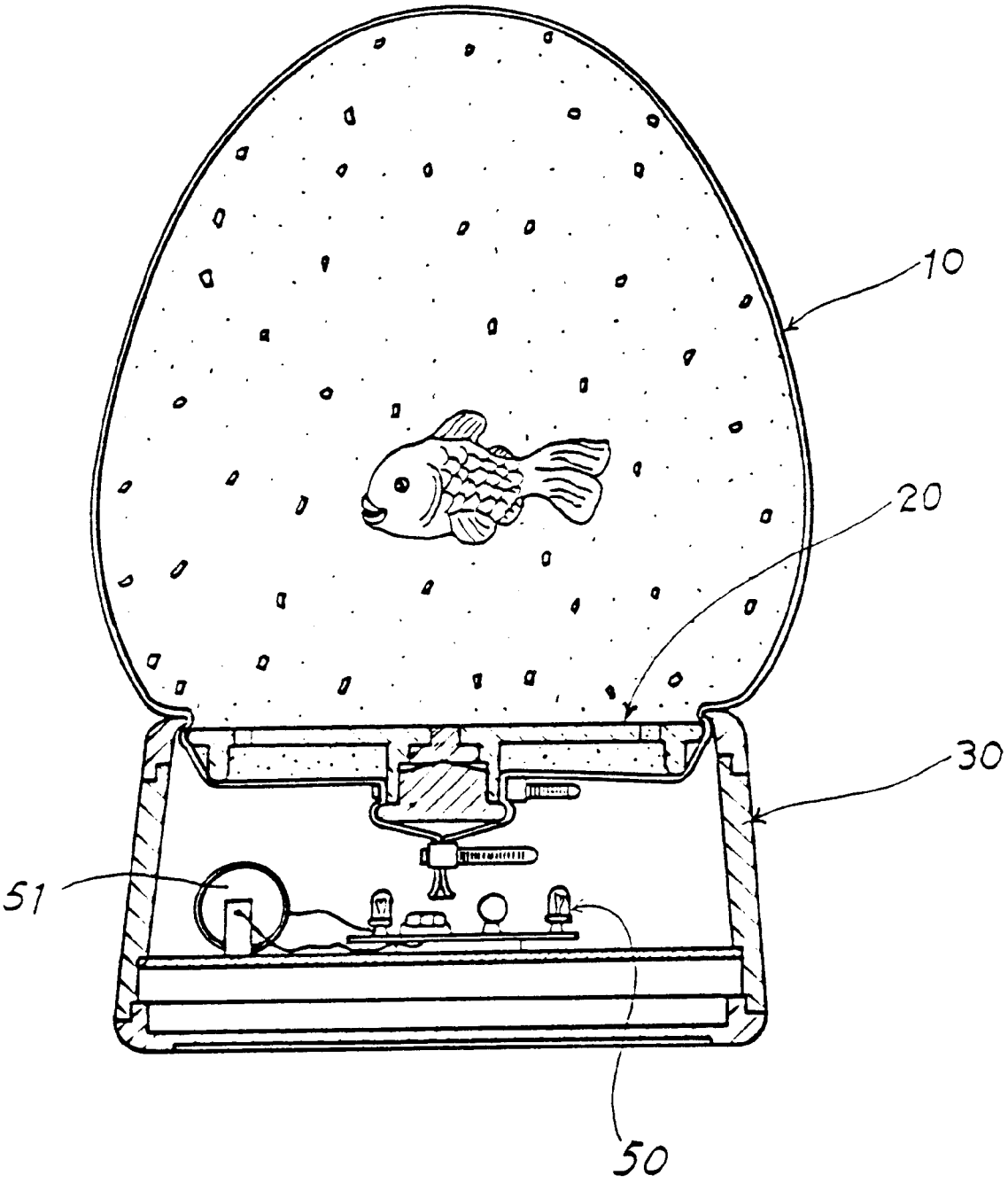
FIG. 4 is a sectional view of a soft-shelled crystal ball according to another embodiment of the present invention.

FIG. 4 shows a soft-shelled crystal ball according to a second embodiment of the present invention. In this embodiment, the baffle 20 is made of a transparent material and the seat 30 is internally provided with a lighting means 50 powered with, for example, a battery 51, and other related switching means. When the lighting means 50 is switched on to emit light, the light penetrates the transparent baffle 20 to shine the crystal ball, making the same particularly attractive in the night or at a dark place.

With the above arrangements, the soft-shelled crystal ball according to the present invention can be more easily filled with liquid via the filling port provided on the baffle and the filling port and the soft shell can be easily sealed with commercially available means, including the plastic plugs and the toothed binding belts, to lower manufacturing cost and ensure good leakproof effect thereof. Meanwhile, the baffle of the soft-shelled crystal ball of the present invention allows easy generation of liquid flows and moving floating decorations in the crystal ball to create dynamic visions before a user. The crystal ball of the present invention is therefore more practical for use and superior to the conventional crystal balls.

What is claimed is:

1. A soft-shelled crystal ball comprising a thin and soft shell made of a transparent plastic material adapted to contain a predetermined amount of liquid and floating decorative articles therein to provide a spherical body for said crystal ball, a disc-shaped baffle having a predetermined thickness and being positioned in said soft shell near a lower opening thereof, and a seat including detachably connected upper ring portion, middle annular wall portion and bottom; said soft-shelled crystal ball being characterized in that said baffle includes a downward extended filling port, an upper part of which defining an internal downward expanded stepped filling hole that is tightly sealed with a first stepped plug made of a soft and elastic plastic material and is therefore leakproof, a lower part of said filling port on said baffle being a tube portion defining an expanded inner hole tightly sealed with a second plastic plug, said second plastic plug having a conic front adapted to press against said first stepped plug to ensure tight and firm location of said first stepped plug in said stepped filling hole; that a first extension portion of said thin and soft shell that is closely below said baffle is tightened around said tube portion of said filling port on said baffle by means of a first fastener, and a second extension portion of said thin and soft shell that extends beyond said tube portion being further tightened below said second plug by mean of a second fastener; and that said baffle having a plurality of through holes evenly distributed thereon and a plurality of stubs having a predetermined length evenly provided along a bottom outer periphery of said baffle, and said stubs supporting and separating said first extension portion of said soft shell from a lower surface of said baffle so that a lower space is provided in said soft shell below said baffle to be communicable with said crystal ball via said through holes.

2. A soft-shelled crystal ball as claimed in claim 1, wherein said baffle is made of a transparent material and said seat is internally provided with a lighting means for emitting light to penetrate said transparent baffle and shine said crystal ball.

* * * * *